United States Patent [19]

Carroll et al.

[11] 4,036,622

[45] July 19, 1977

[54] METHOD AND APPARATUS FOR FORMING GLASS STRAND

[75] Inventors: Thomas D. Carroll, Shelby; Christopher G. Cross, Forest City, both of N.C.

[73] Assignee: PPG Industries, Inc., Pittsburgh, Pa.

[21] Appl. No.: 693,057

[22] Filed: June 4, 1976

[51] Int. Cl.[2] ..... C03B 37/02

[52] U.S. Cl. ..... 65/3 R; 65/2; 65/11 W; 65/29; 65/160; 200/61.18; 226/11; 226/45; 242/18 G; 242/37 R

[58] Field of Search ..... 65/2, 3, 11 W, 29, 160; 425/66; 242/18 G, 37 R, 38, 29, 36, 49, 57; 226/11, 45; 200/61.18

[56] References Cited

U.S. PATENT DOCUMENTS

| | | | |
|---|---|---|---|
| 2,873,718 | 2/1959 | Brautigam | 65/11 W X |
| 3,222,151 | 12/1965 | Schreffler | 65/29 |
| 3,268,314 | 8/1966 | Stephens et al. | 242/37 R X |
| 3,370,800 | 2/1968 | Haberbern | 242/36 |
| 3,516,809 | 6/1970 | Underwood et al. | 65/2 X |
| 3,560,178 | 2/1971 | Minkler | 65/11 W |
| 3,561,689 | 2/1971 | Morgan | 242/37 R |
| 3,844,497 | 10/1974 | Harrill et al. | 65/11 W X |

*Primary Examiner*—Robert L. Lindsay, Jr.
*Attorney, Agent, or Firm*—Alan T. McDonald; John E. Curley

[57] ABSTRACT

A method and apparatus is disclosed for protecting the apparatus employed in the formation of glass fibers, glass fiber strands and the products produced therein. The method involves continuously contacting the moving glass fiber strand during the forming thereof from glass fibers with a strand detecting means provided between a gathering shoe and winding means and automatically deactivating the winding means and spiral assembly associated therewith in addition to protecting the application surface of the applicator when a loss of contact of strand between the gathering shoe and winding means is detected. This deactivation of the winding means and spiral prevents damage from glass beads which may form after a strand breakout in a glass fiber forming operation. The strand breakout is detected by means located between the gathering shoe and collet. Specifically disclosed as a detecting means is a pivoted bar which is held in position against the strand when it is running to deenergize a control circuit when the strand is being wound and which will pivot freely to energize the control circuit should a strand breakout occur.

16 Claims, 5 Drawing Figures

METHOD AND APPARATUS FOR FORMING GLASS STRAND

BACKGROUND OF THE INVENTION

Glass strands are commonly formed by attentuation of molten glass contained in a bushing through bushing tips located at the bottom of the bushing. The filaments drawn from the bushing tips are passed across the application surface of an applicator where they are coated with a binder and/or size. The filaments are then gathered into one or more unified strands by a gathering shoe, which is typically a grooved wheel or cylinder formed of materials such as graphite. The unified strand or strands traverse across the face of a rotating spiral and are collected in a criss-cross pattern as a forming package on a rotating collet.

Ideally, this process is virtually continuous, being stopped only for doffing a complete forming package and beginning the winding of a new one. However, this ideal is not always obtainable. For numerous reasons, including variations in bushing temperature, roughened surfaces of the spiral, applicator, or gathering shoe, flooding of the bushing and the like, breakouts of the glass strand can occur. When these breakouts do occur, glass beads may be formed under the bushing tips where the filaments are drawn. These beads are extremely hot and will burn the application surface of the applicator if they come into contact with it as they drop from the bushing. Since the application surface is typically formed of a material such as rubber and is smooth so that the filaments travel over it with minimum friction, any roughening of the surface caused by burning of the surface leaves a location on the surface for glass filaments to catch and again breakout. Thus a damaged applicator surface must be replaced, necessitating a time delay and the cost of replacement. In addition, any glass beads dropping from the bushing may enter the reservoir in the applicator containing the binder and/or size and contaminate this material or foul parts of the applicator. This can result in necessitating replacement of the binder and/or size and/or a clean up of the applicator.

Likewise, spiral damage may result from contact with the glass beads when a breakout of strand occurs. Should a glass bead come in contact with the spiral while it is rotating at high speed, this large bead, in relation to the size of the glass strand, may, due to the combined effects of the mass of the bead and the momentum of the rotating spiral, nick the surface of the rotating spiral. Any such nick is another location where strand may catch and again breakout when the process is resumed. Thus, as with the applicator, a time consuming and costly replacement of the spiral is often necessitated by its contact with glass beads.

Finally, the strand on the forming package, which is fragile and highly susceptible to damage by abrasion, will be harmed should it come into contact with glass beads falling from a bushing after a breakout as the winder is rotated. The bead damage is often severe enough that the entire forming package must be scrapped since the hot beads hitting a rotating package dissipate across the surface causing extensive damage across the length and circumference of the package.

It is desirable, therefore, to protect the glass fiber forming operation as much as possible from the harmful effects of a breakout.

In U.S. Pat. No. 3,560,178 an apparatus is disclosed for detecting the breakout of strand in a glass fiber forming operation. The apparatus includes a pivoted gathering shoe which is electrically connected to the power supply for the spiral and collet. The apparatus includes no means to protect the applicator from bead damage. More importantly, there exist problems with this structure. Since the rotation of the gathering shoe connects and disconnects the power supply to the collet and spiral, and since the gathering shoe may rotate while the strand is passing therethrough by the force exerted by the downwardly passing strand, power can be cut to the collet and spiral while strand is still passing through the gathering shoe without a breakout having occurred. In addition, the apparatus of this patent includes a liquid mercury switch. Such a switch is highly susceptable to vibration. Vibrations will occur in glass fiber formation, with the result that the mercury switch may trip itself and cut power to the collet and spiral, again without a breakout having occurred.

Further, this system is difficult to keep free of accumulated binder and/or size and it thus has a tendency to gum up. The result of this tendency to gum up is that the gathering shoe often fails to pivot properly upon a strand breakout and thus fails to protect the glass fiber forming apparatus.

It is desirable, therefore, to provide a strand breakout detection system of increased reliability over the prior art systems.

SUMMARY OF THE INVENTION

By means of the present invention, harmful effects caused by glass beads that form upon strand breakout are substantially reduced. In one aspect of the present invention, the presence of glass strand between the gathering shoe and rotating collet is continuously detected by contacting the strand continuously with a strand detecting means located between the gathering shoe and the collet. Should an absence of strand be detected, as determined by loss of contact of strand with the detecting menas, a circuit means is automatically energized which causes a deactivating of the collet and stops its rotation. By stopping the rotation of the collet, glass bead damage to the strand wound onto the collet can be localized and thus minimized. This results in less strand having to be scrapped when the package is subjected to the normal end finding operation that follows.

In another aspect of the present invention, upon detection of the absence of strand, the circuit means which is energized deactivates the rotating spiral and stops its rotation. By stopping the rotation of the spiral, its momentum is reduced to zero and glass beads, which are traveling at a slow speed, will be far less likely to damage the spiral surface if they do come into contact with it.

In a still further aspect of the present invention, upon detection of the absence of strand, a second circuit means is energized which activates means for closing a cover over the application surface of the applicator. This prevents glass beads from coming into contact with the application surface and burning it. The closure also prevents beads from entering the applicator and fouling the internal parts of the applicator or contaminating the binder and/or size contained therein. Optionally, this circuit may also activate a signal for the operator that this forming position is in need of attention.

In the preferred embodiment, all of the above operations are accomplished. Thus, upon detection of a strand breakout, as determined by continuously detecting the presence of strand between the gathering shoe and collet and determining the absence of strand therebetween, a first circuit means is energized which automatically stops rotation of the collet and the spiral and a second circuit means is energized which activates means for closing a cover over the application surface of the applicator and optionally signaling the operator of the occurrance.

Each protective act performed in accordance with the present invention can reduce the downtime for the system, thus increasing productivity, and reduce replacement costs. In addition, considerable savings in the amount of strand wasted by bead damage can be realized.

BRIEF DESCRIPTION OF THE DRAWINGS

The invention will be more readily appreciated by reference to the following drawings in which.

DETAILED DESCRIPTION OF THE DRAWINGS

Figure 1:
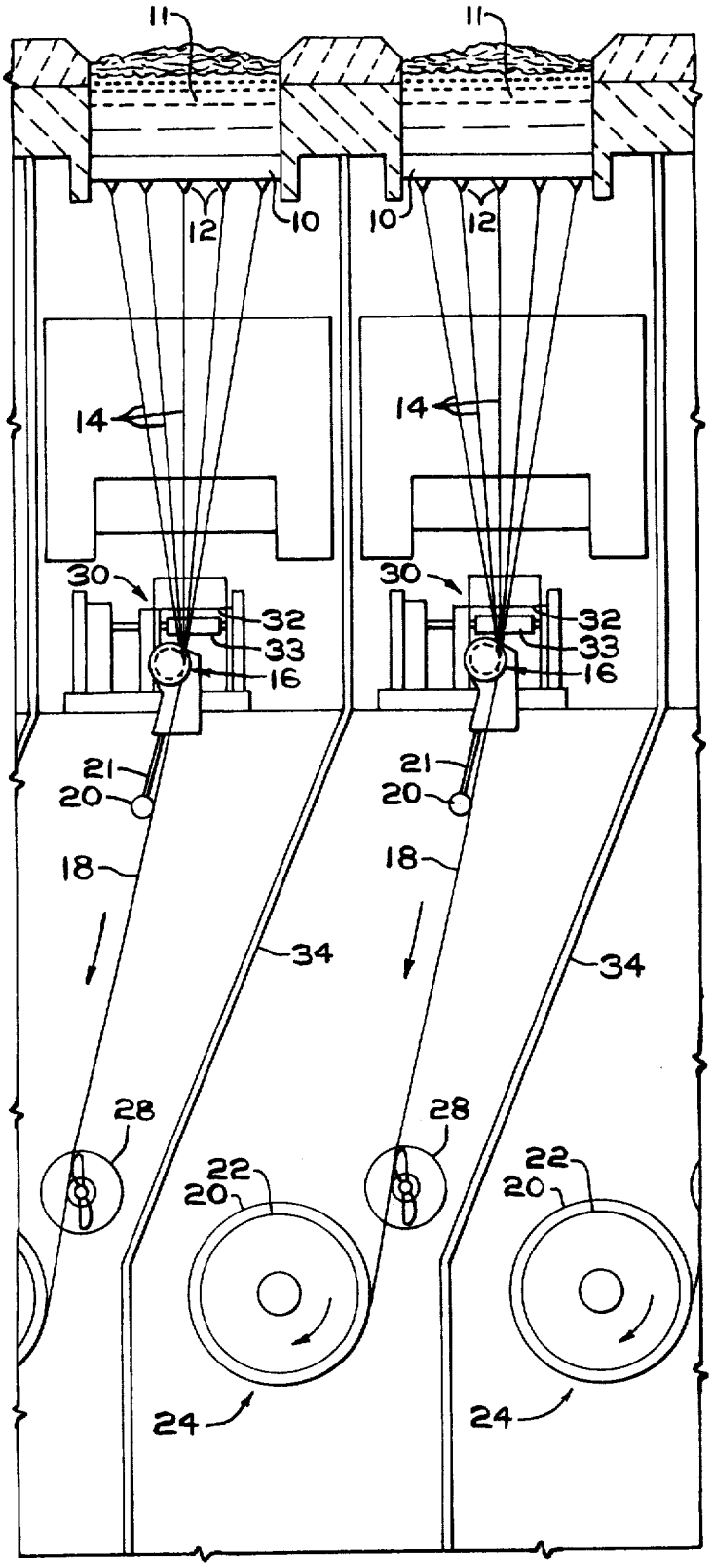
FIG. 1 is a diagrammatic front elevational view of the formation of glass fibers according to the present invention.
Figure 3:
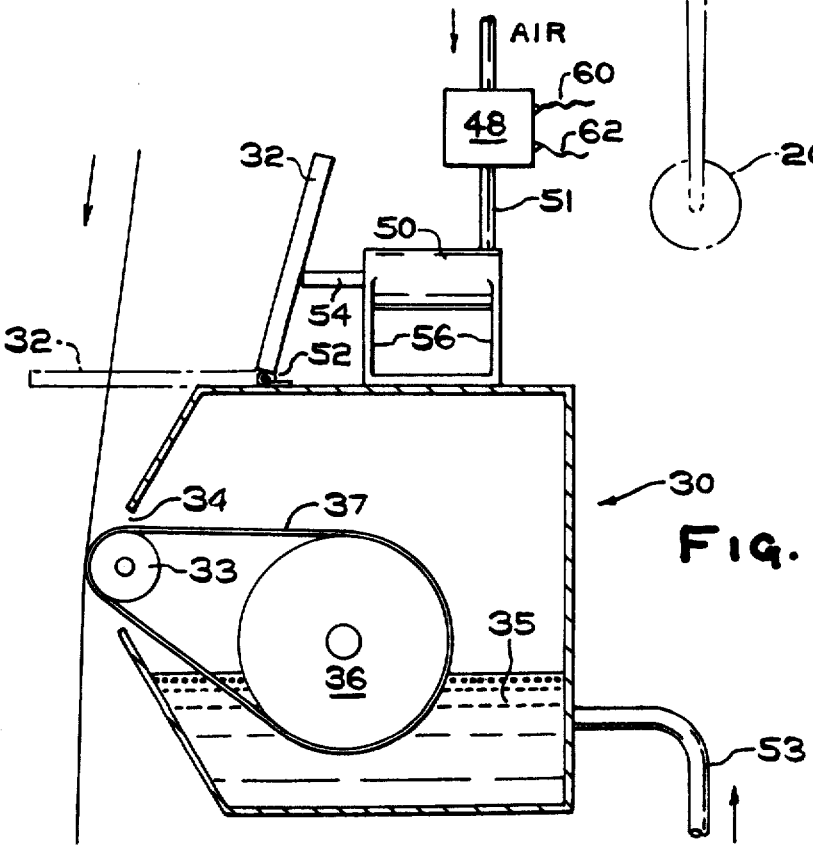
FIG. 3 is an enlarged side sectional view of the applicator, illustrating the means for protecting the application surface.

Turning now to FIG. 1, molten glass 11 is contained in a glass fiber forming bushing 10. Filaments 14 are attenuated through bushing tips 12 at the bottom of the bushings 10. The filaments 14 are drawn across the application surface 37 of an applicator 30 where a binder and/or size is applied to the filaments 14. The applicator 30 may be a roller applicator, a belt applicator or the like. The applicator 30 is illustrated as a belt applicator having rollers 33 and 36 with surrounding belt 37 as the application surface, as can be seen in FIG. 3. The filaments 14 are then passed across a gathering shoe 16 where they are gathered into a unified strand 18. The strand 18 traverses across the face of a rotating spiral 28 and is gathered as a forming package 20 on the face of a rotating collet 22 carried on a winder 24. Located below the gathering shoe 16 and between the gathering shoe 16 and the spiral 28 is the strand detecting means. Preferably the means comprises a pivoted bar 20 connected to a pivoting rod 21, as will be more fully explained below.

Figure 4:
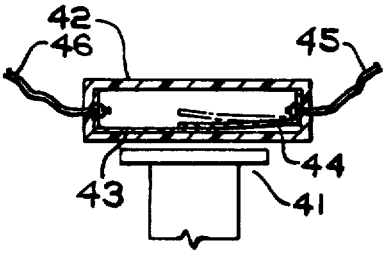
FIG. 4 is an enlarged view of the magnetic switch employed in the present invention.
Figure 2:
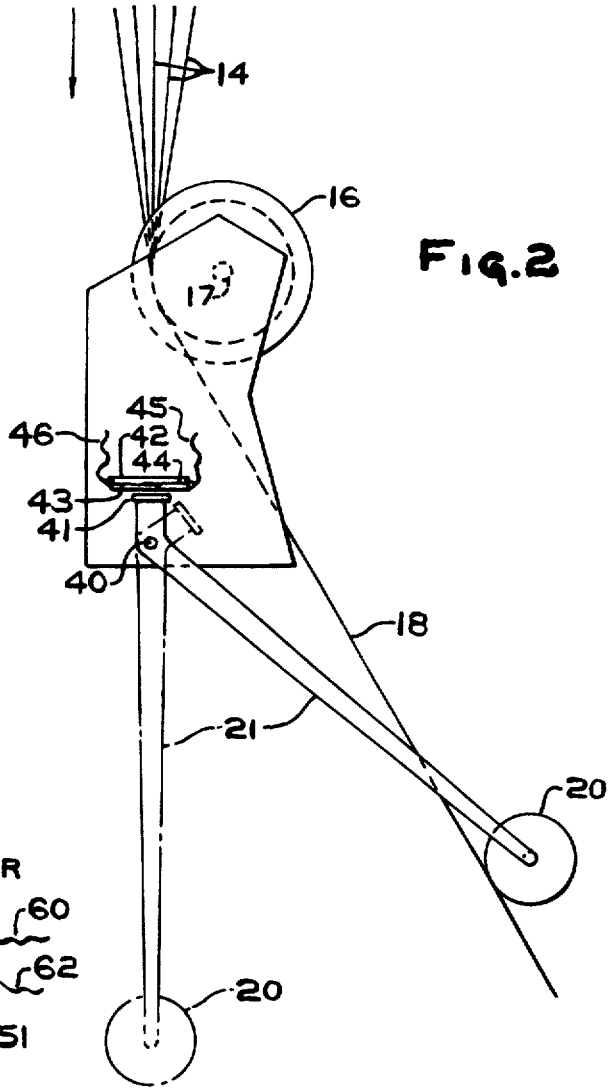
FIG. 2 is an enlarged view from behind the gathering shoe illustrating the operation of a first embodiment of detecting means employed in the present invention.

The operation of one embodiment of the strand detecting means is more fully illustrated in FIG. 2. Looking at FIG. 1 and FIG. 2, FIG. 2 illustrates the back of the gathering shoe 16. The filaments 14 enter the gathering shoe as single filaments and are gathered by the shoe 16 into a unified strand 18. The strand 18 then passes from the spiral to the collet 22 (FIG. 1). As the strand, which travels at an angle from the vertical, passes from the gathering shoe 16 to the winder 24 (FIG. 1), the strand 18 holds a bar 20, such as a circular, cylindrical bar, at this angle away from the vertical. The bar 20 is connected to a rod 21 which is pivoted at 40. The rod 21 has connected at its other end a magnet 41. When strand 18 is passing between the gathering shoe 16 and the collet 22, the pivoted bar 20, which is constantly monitoring the presence of the strand and in contact with the strand, is held in place away from the vertical which in turn positions the magnet 41 directly below a magnetic switch 42, such as an epoxy encased Reed switch 42, as illustrated in FIG. 4. The magnetic switch 42 closes an electric control circuit (not shown) when activated by the magnetic force of the magnet 41. When the magnet 41 is located below the switch 42 contact 44 is brought into contact with contact 43, thus closing the control circuit through power lines 45 and 46. Such a switch is not highly susceptible to vibrations and would not be inadvertently tripped by such vibrations. This control circuit is connected to a second power circuit (not shown) which supplies the electric power to rotate the collet 22 and the spiral 28. The bar 20 is located in position to energize the power circuit and detect the presence of strand 18 by the operator when threading the strand 18 through the gathering shoe 16, the spiral 28 and onto collet 22 to begin winding strand so that power may be supplied to the spiral 28 and the collet 22 during startup.

Should the strand 18 break and loss of contact result, the bar 20, due to gravity, will detect the breakout by pivoting around point 40 to the vertical position as shown in the broken lines of FIG. 2. When this occurs, the magnet 41 rotates away from the magnetic switch 42 and contact 44 rises out of contact with contact 43 thus energizing the control circuit connected to the magnetic switch 42 by power lines 45 and 46 and deenergizing the power circuit. This deenergizing of the power circuit cuts power to the spiral 28 and the collet 22 causing these elements to stop rotating.

In addition, the magnetic switch 42, as shown, may be connected to a second circuit (not shown) which, upon opening of th magnetic switch, activates means for closing the protective cover 32 over the application surface 37 of the applicator 30 as will be explained below. This second circuit also turns on a light to indicate to the operator that the forming position is in need of attention.

Since the pivoted bar 20 and magnet 41 are held in place by the strand, the protection system cannot be activated without an actual strand breakout occurring.

Figure 5:
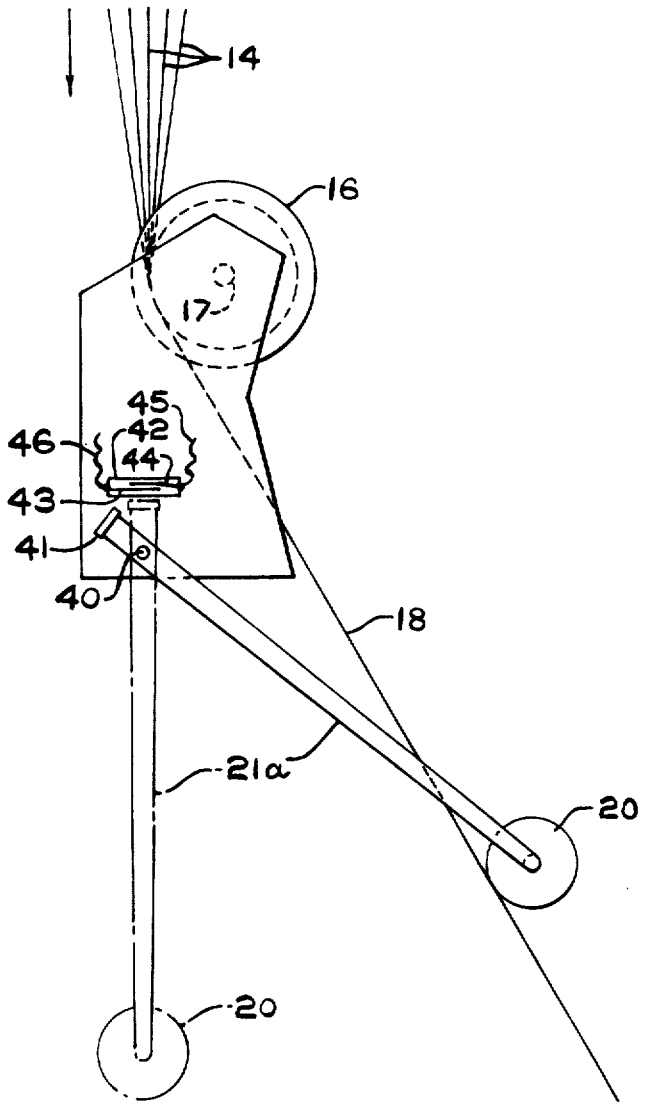
FIG. 5 is an enlarged view from behind the gathering shoe illustrating the operation of a second embodiment of the detecting means employed in the present invention.

FIG. 5 illustrates a second embodiment of the strand detecting means. In this embodiment, a pivoting rod 21*a* is connected to the pivoted bar 20 at one end and to the magnet 41 at its other end. Unlike the bar 21 (FIG. 2), bar 21*a* is designed to hold the magnet 41 away from the magnetic switch 42 strand 18 is passing between the gathering shoe 16 and the collet 22 (FIG. 1).

In this embodiment, the magnetic switch 42 is open while strand 18 is in contact with the pivoted bar 20, thus deenergizing the control circuit. When the control circuit is in a deenergized state, the power supply to the collet and spiral is in an activated condition.

Should the strand 18 break and loss of contact result, in this embodiment, the bar 20 will again pivot around point 40. This will locate the magnet 41 directly below the magnetic switch 42, close the switch 42, and energize the control circuit through power lines 45 and 46. The control circuit responds by deactivating the power supply to the winder and the spiral thus deactivating the collet 22 and spiral 28. A second circuit may also be energized by the control circuit to close the cover 32 over the application surface 37 of the applicator 40. Only a momentary passing of the magnet 41 below the switch 42 is necessary to activate the circuit, the magnet 41 need not come to rest below the switch 42 to activate the control circuit.

In FIG. 3, the preferred apparatus for closing the cover over the application surface is illustrated. When the magnetic switch 42 is open and the second circuit is thus energized, a solenoid valve 48 is signaled through electrical lines 60 and 62 and allows air to pass to an inlet 51 of an air cylinder 50. The air cylinder 50 has a protruding piston 54 on which cover 32 rests during strand attenuation. The cover 32 is connected to the top of the applicator by means such as a hinge 52. The air cylinder is also attached to the applicator by means such as bracket 56. Upon air flowing through the air cylinder 50, piston 54 extends forward, pushing the cover 32 forward and thus rotating it into a closed position. Preferably, the air cylinder 50 is of the type in which piston 54 extends when air is supplied and retracts when air flow ceases. Cover 32 is of a sufficient length that it completely shields the application surface 37 and the opening 34 to the reservoir 35 of the applicator from any glass beads which may fall from the bushing 12 above. Thus damage to the application surface 37 and contamination of the reservoir 35 and internal parts of the applicator 30 is virtually eliminated.

The specific form of circuitry employed in the various control circuits used in the practice of this invention is of no particular significance so long as the circuits employed function to respond to a strand breakout or a signal from another circuit. Application of standard, commercially available control circuits to the apparatus shown is contemplated. Further, while a pneumatic system is shown employed to move the cover of the applicator, recourse to mechanical and electromechanical machinery to accomplish this function is within the contemplation of the disclosed invention.

While the present invention has been described with reference to certain specific illustrated embodiments thereof, it is not intended that the invention be limited thereby, except as insofar as appears in the accompanying claims.

We claim:

1. In a method of forming glass strand comprising attenuating glass filaments from molten glass contained in a bushing through orifices in the bushings, applying a binder and/or size to the filaments from an application surface of an applicator, gathering the filaments into a unified strand in a gathering shoe, traversing the strand across the face of a rotating spiral, and collecting the strand on a rotating collet, the improvement comprising: continuously contacting the strand with a strand detecting means, said means comprising a gravitationally activated pivoting rod means provided between the gathering shoe and the collet and independent of the gathering shoe, and automatically energizing a circuit means to deactivate the collet in response to a loss of contact of the detecting means with said strand.

2. The method of claim 1 further comprising automatically deactivating the spiral in response to a loss of contact of strand with said detecting means.

3. The method of claim 2 further comprising automatically energizing a second circuit means to cover the application surface of the applicator in response to a loss of contact of strand with said detecting means.

4. In a method of forming glass strand comprising attenuating glass filaments from molten glass contained in a bushing through orifices in the bushing, applying a binder and/or size to the filaments from an application surface of an applicator, gathering the filaments into a unified strand in a gathering shoe, traversing the strand across the face of a rotating spiral and collecting the strand on a rotating collet, the improvement comprising: continuously contacting the strand with a strand detecting means, said means comprising a gravitationally activated pivoting rod means provided between the gathering shoe and the collet and independent of the gathering shoe, and automatically energizing a circuit means to cover the application surface of the applicator in response to a loss of contact between the strand and the detecting means.

5. A method of forming glass strand comprising attenuating filaments from molten glass contained in a bushing through orifices in the bushing, applying a binder and/or size to the filaments from an applicaton surface of an applicator, gathering the filaments into a strand in a gathering shoe, traversing the strand across the face of a rotating spiral, winding the strand on a rotating collet, contacting the strand continuously with a strand detection means comprising a gravitationally activated pivoting rod means provided between the gathering shoe and the collet and independent of the gathering shoe and automatically energizing a circuit means to deactivate the collet in response to a loss of contact of the strand with the detection means.

6. The method of claim 5 further comprising automatically deactivating the spiral in response to a loss of contact of strand with said detection means.

7. The method of claim 6 further comprising automatically energizing a second circuit means to cover an application surface of an applicator in response to a loss of contact of strand with said detection means.

8. The method of forming glass strands comprising attenuating glass filaments from molten glass contained in a bushing through orifices in the bushing, applying a binder and/or size to the filaments from an application surface of an applicator, gathering the filaments into a unified strand in a gathering shoe, traversing the strand across the face of a rotating spiral, winding the strand on a rotating collet, contacting the strand continuously with a strand detection means comprising a gravitationally activated pivoting rod means provided between the gathering shoe and the collet and independent of the gathering shoe and automatically energizing a circuit means to cover the application surface of the applicator in response to a loss of contact between the strand and the detection means.

9. Apparatus for forming glass strand comprising a bushing having a plurality of orifices, an applicator having an application surface, a gathering shoe, a rotating spiral, a rotating collet, a gravitationally activated pivoting rod means independent of the gathering shoe contacting the strand between the gathering shoe and the collet, circuit means responsive to movement of said means contacting the stand and means responsive to said circuit means to deactivate the collet.

10. The apparatus of claim 9 further comprising means responsive to said circuit means for automatically deactivating the spiral.

11. The apparatus of claim 10 further comprising a second circuit means responsive to said first circuit means, said second circuit means being connected to means for automatically covering the application surface of the applicator.

12. Apparatus for forming glass strand comprising a bushing having a plurality of orifices therein, an applicator having an application surface, a gathering shoe, a rotating spiral, a rotating collet, a gravitationally activated pivoting rod means independent of the gathering shoe contacting the strand between the gathering shoe and the collet, circuit means responsive to said means contacting said strand and means responsive to said circuit means for automatically covering the application surface of the applicator in response to a loss of contact of the strand with the means contacting the strand between the gathering shoe and the collet.

13. The apparatus of claim 9 wherein said means contacting the strand comprises a pivoted bar connected to a pivoting rod, said pivoting rod having a magnet at one end operatively associated with a magnetic switch, said switch being connected to said circuit means.

14. The apparatus of claim 12 wherein said means contacting the strand comprises a pivoted bar connected to a pivoting rod, said pivoting rod having a magnet at one end operatively associated with a magnetic switch, said switch being connected to said circuit means.

15. The apparatus of claim 13 wherein said magnetic switch is an encapsulated reed switch.

16. The apparatus of claim 14 wherein said magnetic switch is an encapsulated reed switch.

* * * * *